United States Patent [19]

Beck

[11] 4,099,630

[45] Jul. 11, 1978

[54] PIPE HANDLING APPARATUS

[76] Inventor: Don D. Beck, Box 1369, Odessa, Tex. 79760

[21] Appl. No.: 165,953

[22] Filed: Jul. 26, 1971

Related U.S. Application Data

[63] Continuation of Ser. No. 17,768, Mar. 9, 1970, abandoned.

[51] Int. Cl.[2] ..... E21B 19/00

[52] U.S. Cl. ..... 214/2.5; 104/112; 175/85; 212/72; 212/73; 214/1 P; 214/152

[58] Field of Search ..... 214/2.5, 1 P, 152, 12–15 R, 214/94; 212/72–123; 104/112–117; 175/52, 85

[56] References Cited

U.S. PATENT DOCUMENTS

| | | | |
|---|---|---|---|
| 736,996 | 8/1903 | Miller | 212/72 |
| 814,933 | 3/1906 | Bendickson | 104/112 X |
| 890,306 | 6/1908 | Schmertz | 214/2.5 X |
| 916,281 | 3/1909 | Ducrow | 104/114 |
| 1,260,081 | 3/1918 | Skelton | 214/3.1 |
| 2,371,887 | 3/1945 | Hamilton, Jr. | 212/77 X |
| 2,448,324 | 8/1948 | Pool | 214/2.5 |
| 2,690,846 | 10/1954 | Putnam | 214/2.5 |
| 3,011,653 | 12/1961 | Larsen | 212/91 |
| 3,333,713 | 8/1967 | Cruciani | 104/112 X |
| 3,368,699 | 2/1968 | Scaggs | 214/2.5 |

*Primary Examiner*—Frank E. Werner
*Attorney, Agent, or Firm*—Fleit & Jacobson

[57] ABSTRACT

Pipe handling apparatus for transporting pipe between a derrick floor and a pipe rack by a cable-way. A portion of the cable overhangs the derrick floor and the pipe rack. Spaced apart pipe receiving carriages are supported by the cable and are provided with means for being moved from a location adjacent to the derrick floor to a location which overhangs the pipe rack. The tension of the cable is controlled in a manner which enables the pipe receiving carriages to be vertically positioned with respect to the pipe rack.

27 Claims, 11 Drawing Figures

PIPE HANDLING APPARATUS

This is a continuation of Ser. No. 17,768, filed Mar. 9, 1970, now abandoned.

BACKGROUND OF THE INVENTION

During borehole forming operations as well as subsequent work which may be carried out on boreholes wherein a well derrick is positioned over the borehole, it is necessary to handle thousands of feet of tubular goods such as drill pipe, production tubing, casing, and the like. The sections or "joints" of pipe are extremely heavy and dangerous to handle. Transporting the tubular goods from the derrick floor to the pipe rack, and vice versa, constitutes one of the most hazardous aspects of a well boring operation. The various sections of pipe are generally "laid down" in horizontal rows in side-by-side relationship at a location spaced apart from the drilling derrick, and the pipe must be transferred to and from the derrick floor, as necessary. On the other hand, when coming out of the hole with tubular goods, each joint must be broken down from the string of pipe and returned to the pipe rack. Sometime more than 500 joints of drill pipe and drill collar pipe must be handled, and accordingly, a vast amount of labor is expended in racking the pipe.

Various pipe handling apparatus for transferring pipe from a drilling rig floor to a pipe rack are known to those skilled in the art, as evidenced by the patents to Hall, U.S. Pat. No. 2,113,270; Maydew, U.S. Pat. No. 2,852,147; and Freeman, U.S. Pat. No. 3,169,645; to which reference is made for further background of the present invention. However, these prior art devices employ apparatus having a rigid trussed framework with rails thereon, all of which must be transported to and erected at the drilling rig site. The prior art pipe handling equipment occupies a considerable amount of the work area in close proximity to the drilling rig. Accordingly, it is desirable to provide a device for transporting pipe between the derrick floor and the pipe rack wherein the apparatus can be used for transporting casing as well as drill pipe and other tubular goods while at the same time the area immediately adjacent the drilling rig is left unencumbered by equipment. It is also desirable to provide apparatus of this nature which is economical to fabricate, efficient in operation, and easy to erect at the drilling site.

SUMMARY OF THE INVENTION

The present invention relates to a method and apparatus for transporting pipe between a derrick floor and a pipe rack by suspending a cable in overhanging relationship with respect to the derrick floor and the pipe rack while controlling the tension of the cable so as to position a pipe held within spaced apart pipe receiving carriages whereby pipe may be delivered to or removed from the pipe rack, while at the same time, or in conjunction with the tensioning operation, the carriages may be moved longitudinally with respect to the cable. In order to move the carriages, means are provided which enables the carriages to be positioned along a predetermined portion of the cable.

One manner of accomplishing the last mentioned expedient is in the provision of a second cable having the ends thereof attached to independent but coacting drums whereby the drums cooperate together so as to maintain the last mentioned cable tensioned in proportion to the main cable. The carriages have means associated therewith for engaging and disengaging pipe at the derrick floor and at the pipe rack.

Accordingly, a primary object of the present invention is the provision of a method of transporting pipe along a cable and between a derrick floor and a pipe rack.

Another object of the present invention is the provision of apparatus for transporting pipe between geographically spaced apart locations by the utilization of spaced apart carriages which move along a cable which overhangs each said location.

A further object of the present invention is the provision of an elevated cable-way which enables the transportation of tubular goods between a derrick floor and a pipe rack.

Still another object of the present invention is to provide improvements in method and apparatus for racking pipe associated with a borehole forming operation.

These and other objects of the present invention will become readily apparent to those skilled in the art upon reading the following detailed description and by referring to the accompanying drawings.

DETAILED DESCRIPTION OF THE DRAWINGS

Figure 1:
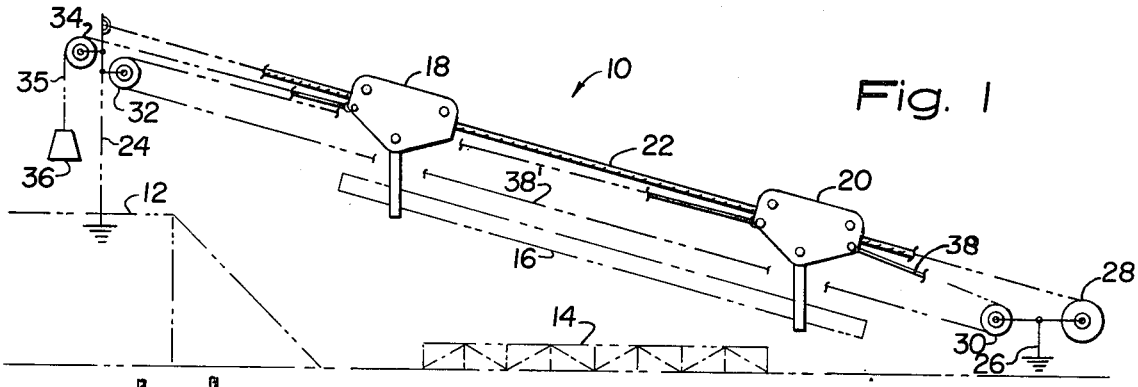
FIG. 1 is a schematic representation of the present invention.

Numeral 10 of FIG. 1, and in the remaining figures, is intended to indicate schematically an elevated cable-way having a portion thereof overlying a derrick floor 12 and a pipe rack 14. Tubular goods 16 are transported between the floor and the rack. Spaced apart pipe receiving carriages 18 and 20 are received for longitudinal movement along a first or main cable 22. The cable is suspended between vertical supporting structure 24 and 26.

Tensioning means 28, which can be in the form of a powered cable drum, is anchored to support 26 for controlling the vertical height of the cable which supports and guides the spaced apart carriages. Secondary cable drums 30 and pulley 32 are positioned out of the path of travel of the carriages and are affixed in journaled relationship to each of the respective support means. Pulley 34 has cable 35 passing partially thereabout with one end attached to counter-balance 36 and the other end attached to the uppermost pipe receiving carriage 18. Attached to the lowermost carriage 20 are cables 38 and 38', with one cable 38' passing over pulley 32 and wound around drum 30 and with cable 38 wound around a drum (not shown) located adjacent to drum 30.

Figure 2:
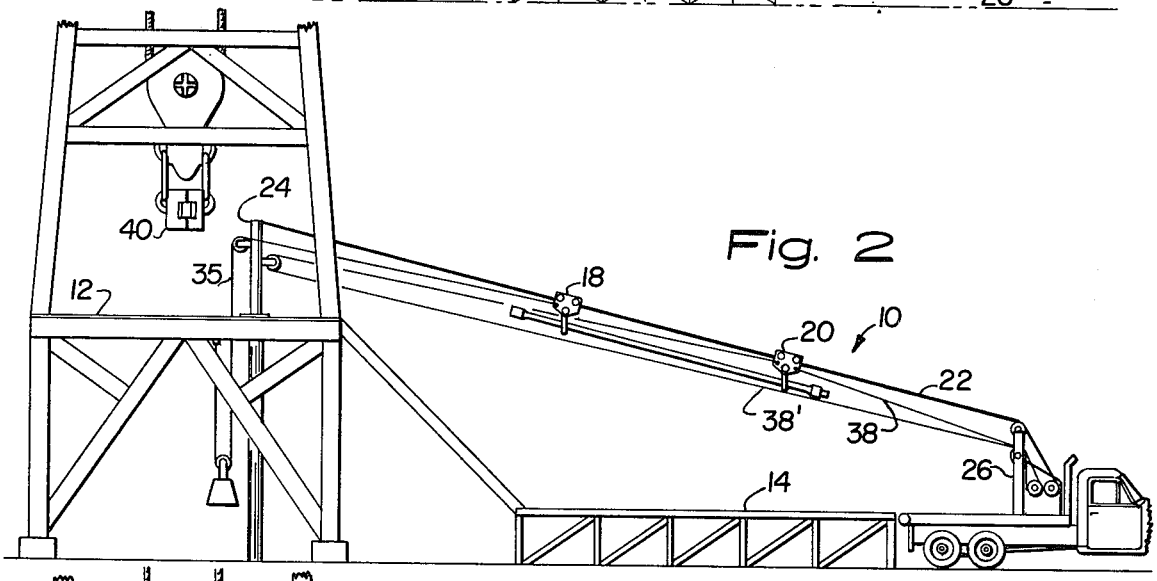
FIG. 2 is a side elevational view showing one embodiment of the present invention.

Looking now in greater detail at one embodiment of the invention, and particularly at FIG. 2, wherein like numerals correspond to like elements of FIG. 1, an elevator 40 is disposed in the usual manner above the derrick floor 12. A truck is positioned adjacent to pipe rack 14. The truck at numeral 26 is provided with the necessary motors and drums for controlling the apparatus.

Figure 3:
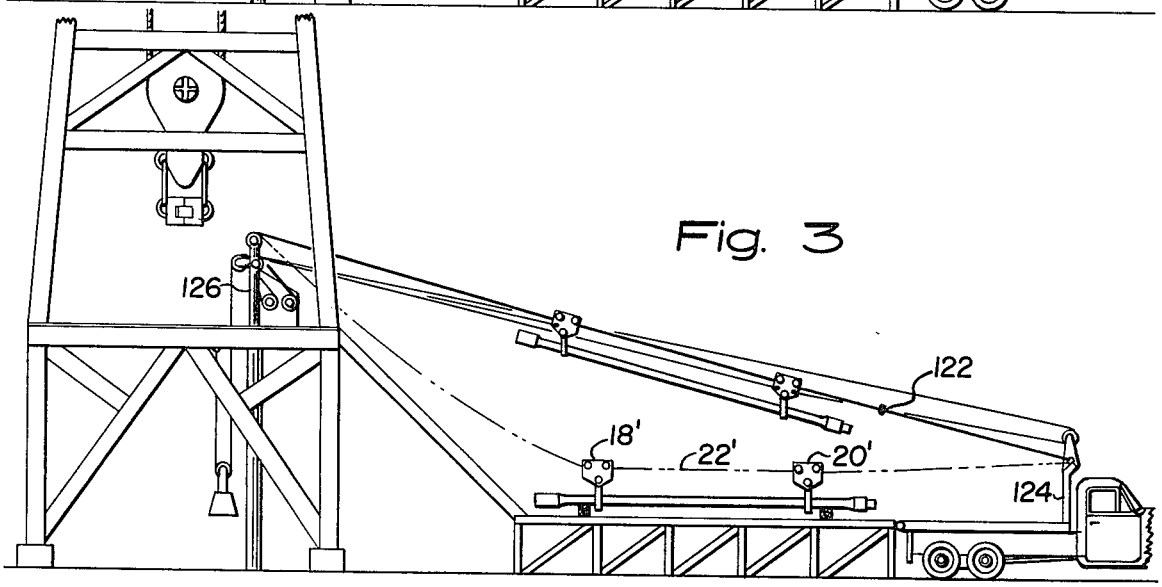
FIG. 3 is a side elevational view showing another embodiment of the present invention.

FIG. 3 discloses the power means and the drums for the apparatus as being located on the derrick floor at 126, while the anchoring means 124 is disposed adjacent the cab of the truck. Numeral 122 indicates the stop means for the lower carriage.

Figure 4:
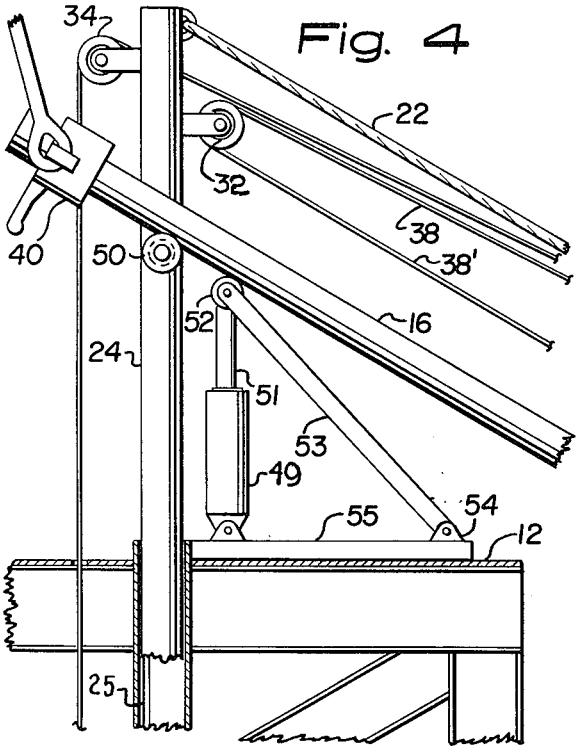
FIG. 4 is an enlarged fragmentary side elevational view partly in cross-section of a portion of the structure shown in FIG. 2.
Figure 5:
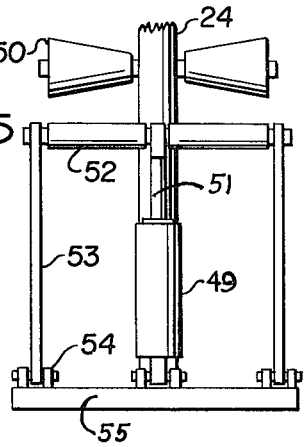
FIG. 5 is an end view looking generally in the direction of arrows 5—5 in FIG. 4.
Figure 6:
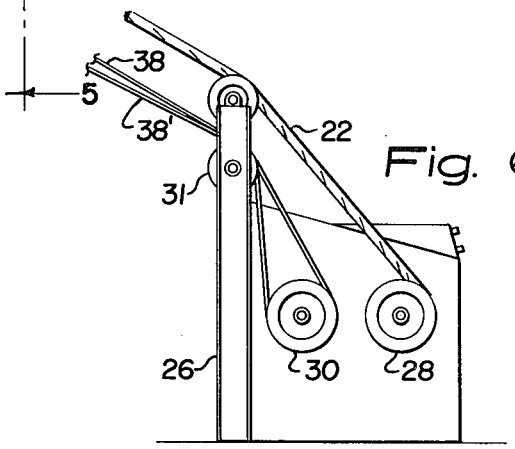
FIG. 6 is an enlarged fragmentary side elevational view of part of the device shown in FIG. 2.

Looking now in greater detail at the various parts of the apparatus, and in particular at FIG. 4, there is seen projecting through the derrick floor tubular member 24 which is suitably anchored to the rig structure as, for example, by being placed in the mousehole 25 provided in the rig floor so as to form an anchoring means for the cable-way. Spaced apart inwardly converging rollers, one of which is indicated by numeral 50, receive pipe 16 in low friction relationship thereon, with the elevators 40 partially supporting one end of the pipe. Spaced apart from and underlying the tapered rollers is a hydraulic ram 49 having piston 51 journaled to spaced apart rollers 52 and articulated by member 53, the ends of which are journaled to the roller shaft and to a suitable fixed base 55. As seen in FIG. 6, each of the secondary cables 38 and 38' pass over adjacent pulleys, one of which is seen at 31, and oppositely wound around and connected to spaced apart drums, one of which is seen at 30, and each of which are connected together by a clutch means. The spaced apart drums at 28 and 30 are attached to conventional power units of a suitable size for tensioning cable 22 and for moving the lower carriage, respectively.

Figure 7:
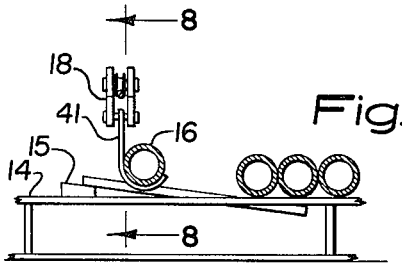
FIG. 7 is an end view of a portion of the apparatus seen in FIGS. 2 and 3.
Figure 8:
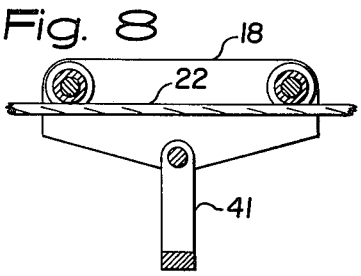
FIG. 8 is a cross-sectional view taken along line 8—8 of FIG. 7.

As illustrated in FIGS. 7 and 8, carriage 18 is comprised of spaced apart plates having rollers journaled therebetween. The rollers and plates cooperate to capture main cable 22 therewithin. A hook 41 has the free depending end thereof formed into a curve so as to conform to and support the outer peripheral surface of a pipe 16. Inclined surface 15 is supported by the pipe rack 14 and forms a portion thereof for rolling pipe away from the carriage after the pipe is laid down.

Figure 9:
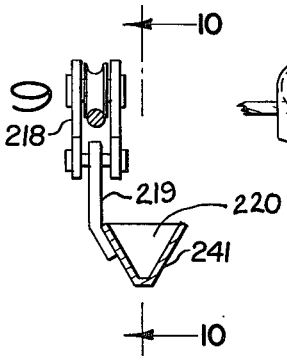
FIG. 9 is another embodiment partly in cross-section of a pipe receiving carriage of the present invention.
Figure 10:
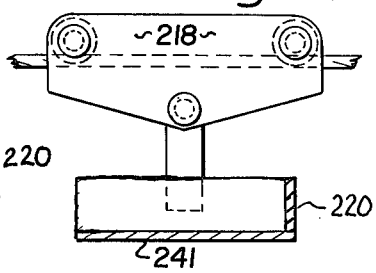
FIG. 10 is a cross-sectional view taken along line 10—10 in FIG. 9.

An alternate form of the pipe receiving carriages is disclosed in FIGS. 9 and 10 which show pipe receiving carriage 218 which has a downwardly converging, upwardly and outwardly opening bucket 241 attached to the lower portion of the carriage 218 by an arm member 219. A vertical bulkhead 220 is provided at one end of the pipe receiving bucket 241 against which the terminal end portion of a pipe may abut.

Figure 11:
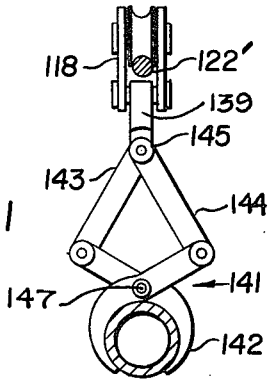
FIG. 11 is yet another embodiment partly in cross-section of a pipe receiving carriage of the present invention.

FIG. 11 shows still another embodiment of the pipe receiving carriages indicated at 118 wherein tongs 141 are journaled to an arm member 139 at 145 to provide a pair of scissor-like linkages 143, 144, each journaled together as illustrated at 147 to present a pipe engaging claw-like member 142. The inside of member 142 is curved in order to receive a pipe therein in the illustrated manner.

OPERATION

In transporting pipe from the pipe rack upwardly to the derrick floor, drum 28 is rotated to relieve the tension in the main cable 22 so as to enable the carriages to vertically descend into the indicated dot-dashed position illustrated in FIG. 3. The pipe is placed or otherwise attached to the pipe receiving portion of the carriages and the cable 22 is tightened by rotating drum 28, whereupon the pipe assumes an elevated position as seen in either of FIGS. 2 or 3.

As cable 22 is tightened, it assumes an inclined position and the weight of the pipe together with the carriages tend to move the carriages on their respective low friction bearings toward the stop means 122 in FIG. 3. In order to control the longitudinal movement of the pipe with respect to the main cable, the secondary cable 38' is wound on its drums by rotating the drum generally indicated at 30 and secondary cable 38 is simultaneously unspooled. This action causes the pipe to be moved by the carriages into the illustrated position of FIG. 4. As the pipe approaches the vertical support member of FIG. 4, roller 52 of the hydraulic ram 49 is moved into contact with the pipe so as to enable the end of the pipe to be lifted clear of roller 50. The elevators are next attached to the box end of the pipe and the pipe is then lifted by the elevator into the vertical position above the turntable of the rig where it can be lowered into the borehole. As the pipe is lifted from carriage 18, it is necessary for carriage 20 to follow and support the remaining free end of the pipe so as to prevent damage to the pin end thereof. This is accomplished by permitting the drums associated with the secondary cables to "free wheel" during this portion of the operation. Once the center of gravity of the pipe has "broke over" the tapered roller 50, the presence of carriage 20 is no longer required for support of the lower end of the pipe. Accordingly, after the pipe clears both carriages, the carriages travel by gravity back into the position overhanging the pipe rack in order to receive another joint of pipe within the pipe receiving carriages. Alternatively, carriage 20 is moved into the position overhanging the pipe rack by rotating the drum cooperating with secondary cable 38 to wind cable 38 on the drum while simultaneously unspooling cable 38'. Positioning of the spaced apart carriages can be accomplished by the illustrated stop means 122 in FIG. 3 located adjacent to the truck end of the main cable and the relative position of the counter-balance 36. In other words, the counter-balance properly positions carriage 18 while the stop means positions carriage 20 with respect to the pipe rack. Alternatively, carriage 20 can be positioned by means of cables 38, 38', described above.

The tension in cable 22 is relieved by rotation of drum 28 whereupon the carriages decend vertically towards the pipe rack and another joint of pipe is placed within the pipe receiving portion of the carriages, with the operation being repeated until perhaps several hundred joints of drill pipe or casing has been delivered to the derrick floor.

Since the secondary cables 38, 38' must generally follow the curve 22' illustrated in FIG. 3 of cable 22, it is necessary to maintain the tension of the secondary cables proportional to the tension of the main cable by relative rotation of the adjacent drums one of which is illustrated at 30. This is best accomplished by a clutch which engages the two drums so as to enable the drums to be controlled jointly or separately. As cable 22 is lowered, the clutch is disengaged to permit relative rotation between the drums 30, which enables the secondary line to be lengthened as required. When the cable 22 is raised, rotation of one drum relative to the other will tighten the secondary cable.

In order to permit the uppermost carriage 18 to return to the pipe rack, it is necessary to support the counterweight at an elevated position relative to the rig structure so as to enable it to act as a stop means, or alternatively, the two carriages may be connected together by still another cable or line (not shown) so as to enable carriage 20 to overcome the weight of the counter-balance and pull the upper carriage 18 to the desired position above the pipe rack.

In coming out of the hole with drill pipe and the like, the before described operation must be reversed and slightly modified. Assuming the elevators 40 have picked up a joint of pipe, a workman moves the pin end of the pipe past roller 50 towards the truck and the elevator is then lowered until the pin end is received within the pipe receiving portion of carriage 20. With the pin end of the pipe supported by the lowermost carriage 20, the elevators are further lowered with the pipe sliding down tapered roller 50 until the box end falls off the roller, past ram 52, where the box end must now fall into or be received by the pipe receiving portion of carriage 18. With the two carriages now supporting the pipe, the secondary cables enable the velocity of the carriages to be controlled as they move towards the truck, until the lowermost carriage abuts its stop means 122 illustrated in FIG. 3 or is stopped by the secondary cables. Cable 22 is then slackened into the dot-dashed position of FIG. 3, whereupon the pipe engaging portion of the carriage is disengaged from the pipe, enabling the pipe to roll away from the carriages in the illustrated manner of FIG. 7. The main cable is now tightened, carriage 20 is moved by means of the secondary cables back into a position where it is ready to receive the pin end of the next joint of pipe, while the counter-balance returns carriage 18 to its position near ram 52.

Those skilled in the art, having studied the drawings together with the above descriptive portions of the specification, will realize that the pipe receiving portion of the carriages disclosed in FIGS. 7 and 8 can either pick up or deliver the pipe at either location by either controlling the tension of the cable at the pipe rack or by the use of the hydraulic ram at the derrick floor.

I claim:

1. Apparatus for handling pipe wherein the pipe is transported between a pipe rack and another location comprising:

a cable; means forming spaced apart pipe receiving carriages; means mounting said spaced apart pipe receiving carriages for longitudinal movement on said cable; means for moving at least one said carriage on said cable; and means anchoring one end of said cable;

means controlling the tension in said cable; said cable adapted to be positioned with part of it disposed in overlying relationship with respect to the pipe rack and part of it being disposed in close proximity to the before mentioned another location;

said means for moving said carriages including a second cable, means by which said second cable is attached to said at least one of said carriages; and, means for moving said second cable so as to enable positioning of the carriage to which said cable is attached;

said means for moving said second cable further includes spaced apart drums, means for rotating said spaced apart drums clockwise and counterclockwise with respect to each other whereby said second cable can move the carriage along the first recited cable and at the same time the length of said second cable can be controlled by the relative rotation of said spaced apart drums.

2. The apparatus fo claim 1 wherein at least one of said pipe receiving carriages include:

pipe engaging tongs, said tongs including a pair of links journaled together at said carriage, another pair of links each having one end portion journaled to one end portion of one of the first recited links; and, said another pair of links having the free depending end portions curved into a claw for engaging the outer peripheral surface of a pipe.

3. The apparatus of claim 1 and further including a hydraulic ram for lifting one end of a pipe when the pipe is in close proximity of the derrick floor.

4. Apparatus for handling pipe wherein the pipe is transported between a pipe rack and another location comprising:

a cable; means forming spaced apart pipe receiving carriages; means mounting said spaced apart pipe receiving carriages for longitudinal movement on said cable; means for moving at least one said carriage on said cable; and means anchoring one end of said cable;

means controlling the tension in said cable; said cable adapted to be positioned with part of it disposed in overlying relationship with respect to the pipe rack and part of it being disposed in close proximity to said another location;

said means for moving said carriages including a second cable attached to at least one of said carriages; and, means for moving said second cable so as to enable positioning of a carriage to which said cable is attached;

at least one of said pipe receiving carriages includes a trough for bottom supporting a pipe, said trough being upwardly opening with downwardly converging side walls, and a vertically disposed bulkhead for abuttingly receiving the end of a pipe joint thereagainst;

said means for moving said second cable includes spaced apart drums, means for rotating said spaced apart drums clockwise and counterclockwise with respect to each other whereby said second cable can move the carriage along the first recited cable and at the same time the length of said second cable can be controlled by the relative rotation of said spaced apart drums.

5. The apparatus of claim 4, and further including a hydraulic ram for lifting one end of a pipe when the pipe is in close proximity of the derrick floor.

6. Apparatus for handling pipe wherein the pipe is transported between a pipe rack and another location comprising:

a main cable; means forming spaced apart pipe receiving carriages; means mounting said spaced apart pipe receiving carriages for longitudinal movement on said main cable; means for moving at least one said carriage on said main cable; and means anchoring one end of said main cable;

means controlling the tension in said main cable; said main cable adapted to be positioned with part of it disposed in overlying relationship with respect to the pipe rack and part of it being disposed in close proximity to the before mentioned another location;

said means for moving said at least one said carriage including second and third cables attached to said at least one said carriage; and, means for moving said second and third cables so as to enable positioning of the carriage to which said second and third cables are attached;

said means for moving said second and third cables further includes spaced apart drums, means for rotating said spaced apart drums whereby said second and third cables can move the carriage along said main cable and positively control the movement of the carriage in both directions under power.

7. The apparatus of claim 6 and further comprising means for moving the other of said spaced apart pipe receiving carriages independently from said at least one said carriage having said second and third cables attached thereto.

8. The apparatus of claim 6 wherein said main cable is suspended in overhanging relation to the derrick floor and the pipe rack by means for rigidly attaching one end of said cable above the derrick floor and a powered rotating drum adapted to be positioned such that the pipe rack is aligned between said powered rotating drum and the derrick floor, the other end of said main cable being attached to said powered rotating drum, said powered rotating drum controlling the tension in said main cable whereby a slackening of the tension will allow said main cable to assume a position adjacent the pipe rack.

9. The apparatus of claim 6 wherein said second and third cables are associated with said spaced apart drums so that said second cable moves said at least one said carriage toward the derrick floor and said third cable moves said at least one said carriage toward the pipe rack.

10. The apparatus of claim 6 wherein said at least one said carriage is positioned between the other of said spaced apart pipe receiving carriages and the pipe rack and is adapted to support the forward end of the pipe to be transported away from the derrick floor, said other of said spaced apart pipe receiving carriages being positioned between said at least one said carriage and the derrick floor and being adapted to support the rearward end of the pipe to be transported away from the derrick floor.

11. The apparatus of claim 6 and further comprising a fourth cable connected between said spaced apart pipe receiving carriages for causing the other of said spaced apart pipe receiving carriages to be moved toward the pipe rack in response to the movement of said at least one said carriage.

12. The apparatus of claim 6 and further including bucket means attached to said at least one said carrier for receiving a pipe therein, said bucket means having a closure means which forms a bulkhead against which an end of the pipe can bear.

13. Apparatus for handling pipe wherein the pipe is transported between a pipe rack and another location comprising:

a main cable; means forming spaced apart pipe receiving carriages; means mounting said spaced apart pipe receiving carriages for longitudinal movement on said main cable; means for moving at least one said carriage on said main cable; and means anchoring one end of said main cable;

means controlling the tension in said main cable; said main cable adapted to be positioned with part of it disposed in overlying relationship with respect to the pipe rack and part of it being disposed in close proximity to the before mentioned location;

said means for moving said at least one said carriage including a second cable attached to said at least one said carriage; and, means for moving said second cable so as to enable positioning of the carriage to which said second cable is attached and to positively control the movement of the carriage in both directions under power;

means for automatically positioning the other of said spaced apart pipe receiving carriages in overhanging relation to the derrick floor whereby the rearward end of the pipe to be transported can be readily supported thereby.

14. The apparatus of claim 13 wherein said means for moving said at least one said carriage includes a third cable and wherein said second and third cables are associated with spaced apart drums so that said second cable moves said at least one said carriage in a first direction along said main cable and said third cable moves the other carriage in a second direction along said main cable.

15. The apparatus of claim 13 wherein said at least one said carriage is positioned between said other carriage and the pipe rack and said other carriage is positioned between said at least one said carriage and the derrick floor.

16. The apparatus of claim 13 wherein said means for automatically positioning said other carriage exerts sufficient force on said other carriage in the direction of the derrick floor so as to overcome the gravitational force exerted by the carriage weight itself, but insufficient force to overcome the gravitational force exerted by the weight of said other carriage plus the pipe when received therein, whereby when the pipe is not supported by said other carriage said other carriage will remain in overhanging relation to the derrick floor, and when the pipe is supported by said other carriage said other carriage will move along said main cable.

17. Apparatus for transporting a pipe between a derrick floor and a pipe rack which is positioned below the level of and away from the derrick floor comprising:

(a) a main cable suspended in overhanging relation to the derrick floor and the pipe rack such that the portion of the main cable suspended over the derrick floor is higher than the portion of the main cable suspended over the pipe rack;

(b) a first and a second wheeled carriage mounted on said main cable for longitudinal movement thereon, said second carriage adapted to support the forward end of the pipe to be transported away from said derrick floor and said first carriage adapted to support the rearward end of said pipe;

(c) means for moving said second carriage independently of said first carriage and for positively controlling the movement of the second carriage in both directions along the main cable under power; and (d) means for controlling the tension in said main cable.

18. A method for transporting a pipe between a derrick floor and a pipe rack which is positioned below the level of and away from the derrick floor comprising:

(a) suspending a main cable in overhanging relation to the derrick floor and the pipe rack such that the portion of the main cable suspended over the derrick floor is higher than the portion of the main cable suspended over the pipe rack;

(b) mounting spaced apart pipe receiving carriages for longitudinal movement on said main cable;

(c) supporting one end of a pipe to be transported in one of said carriages and the other end of said pipe in the other of said carriages;

(d) moving at least one of said carriages along said main cable using second and third cables so as to position the carriage to which said second and third cables are attached, said second and third cables being moved by spaced apart drums rotated in such a manner that said second and third cables move the carriage along said main cable while positively controlling the movement of the carriage in both directions under power; and (e) controlling the tension in said main cable.

19. The method of claim 18 wherein said second and third cables are suspended in overhanging relationship with respect to the derrick floor and the pipe rack.

20. The method of claim 18 and further comprising:

(f) engaging or disengaging the pipe at the pipe rack by reducing the tension of the main cable so as to enable the spaced apart pipe receiving carriages to vertically move into close proximity of the pipe rack; and (g) engaging or disengaging the pipe at the derrick floor from the spaced apart pipe receiving carriages.

21. The method of claim 20 wherein the pipe is transported from the pipe rack to a vertical position above the derrick floor and further comprising:

(h) engaging an end of the pipe at the derrick floor with an elevator means; and (i) elevating said end of the pipe with said elevator means away from the other of said carriages while at the same time moving the other end of the pipe toward the derrick floor by continuing the movement of said at least one of said carriages along said main cable.

22. The method of claim 20 wherein the pipe is transported from an elevated position in a derrick elevator above the derrick floor to the pipe rack and further comprising:

(h) supporting one end of said pipe by said at least one of said carriages;

(i) moving said at least one of said carriages along said main cable away from said derrick floor by means of said second and third cables while the other end of said pipe is lowered toward said other carriage which is maintained in a position overhanging the derrick floor; and (j) supporting the other end of said pipe by said other carriage and disengaging the derrick elevator.

23. A method for transporting a pipe between a derrick floor and a pipe rack which is positioned below the level of and away from the derrick floor comprising:

(a) suspending a main cable in overhanging relation to the derrick floor and the pipe rack such that the portion of the main cable suspended over the derrick floor is higher than the portion of the main cable suspended over the pipe rack;

(b) mounting spaced apart pipe receiving carriages for longitudinal movement on said main cable;

(c) supporting one end of a pipe to be transported in one of said carriages and the other end of said pipe in the other of said carriages;

(d) moving at least one of said carriages along said main cable using a second cable so as to position the carriage to which said second cable is attached and to positively control the movement of said at least one of said carriages in both directions along the main cable under power;

(e) automatically positioning the other of said spaced apart pipe receiving carriages in overhanging relation to the derrick floor whereby the other end of the pipe to be transported can be readily supported thereby; and (f) controlling the tension in said main cable.

24. The method of claim 23 wherein said at least one of said carriages is moved along the main cable by said second cable and a third cable and wherein said second cable is attached to said at least one of said carriages for moving said at least one of said carriages toward the derrick floor and said third cable is attached to said other carriage for moving said other carriage toward the pipe rack.

25. The method of claim 23 and further comprising:

(g) engaging or disengaging the pipe at the pipe rack by reducing the tension of the main cable so as to enable the spaced apart pipe receiving carriages to vertically move into close proximity of the pipe rack; and (h) engaging or disengaging the pipe at the derrick floor from the spaced apart pipe receiving carriages.

26. The method of claim 25 wherein the pipe is transported from the pipe rack to a vertical position above the derrick floor and further comprising:

(i) engaging an end of the pipe at the derrick floor with an elevator means; and (j) elevating said end of the pipe with said elevator means away from said other carriage while at the same time moving the other end of the pipe toward the derrick floor by continuing the movement of said at least one of said carriages along said main cable.

27. The method of claim 25 wherein the pipe is transported from an elevated position in a derrick elevator above the derrick floor to the pipe rack and further comprising:

(h) supporting one end of said pipe by said at least one of said carriages;

(i) moving said at least one of said carriages along said main cable away from said derrick floor while the other end of said pipe is lowered toward said other carriage which is maintained in a position overhanging the derrick floor; and (j) supporting the other end of said pipe by said other carriage and disengaging the derrick elevator.

* * * * *